US005245305A

United States Patent [19]

Ricker

[11] Patent Number: 5,245,305

[45] Date of Patent: Sep. 14, 1993

[54] CIRCUIT BREAKER ENCLOSURE MATERIAL IDENTIFICATION

[75] Inventor: Charles E. Ricker, Bristol, Conn.

[73] Assignee: General Electric Company, New York, N.Y.

[21] Appl. No.: 949,943

[22] Filed: Sep. 24, 1992

[51] Int. Cl.[5] ..... H01H 9/02

[52] U.S. Cl. ..... 335/202; 200/293; 283/92

[58] Field of Search ..... 335/6, 202, 35; 200/293, 294, 296, 303, 304, 305; 283/85, 92

[56] References Cited

U.S. PATENT DOCUMENTS 4,513,268 4/1985 Seymour et al. ..... 335/35
5,005,873 4/1991 West ..... 283/85

*Primary Examiner*—Lincoln Donovan
*Attorney, Agent, or Firm*—Richard A. Menelly

[57] ABSTRACT

The plastic material used to form the case and cover of a molded case circuit breaker includes a filler material such as glass fibers for strength purposes. To insure that the incoming plastic material contains the requisite filler material, a fluorescent material is included with the filler. Illumination of the plastic material under ultra-violet light confirms the presence of the fluorescent material and the filler material prior to fabrication of the circuit breaker case and cover. Illumination of the circuit breaker under ultra-violet light in the field confirms both the presence of the filler material as well as the source of manufacture.

10 Claims, 1 Drawing Sheet

CIRCUIT BREAKER ENCLOSURE MATERIAL IDENTIFICATION

BACKGROUND OF THE INVENTION

Residential and industrial type electrical circuit breakers and switches generally comprise current carrying components contained within an insulative enclosure of molded plastic resins. To provide added strength to the enclosure, fillers such as glass fibers are added to the plastic resins. Since the additives are not visually distinguishable from the plastic material, per se, the enclosures could be fabricated without the fillers included.

The upsurge in the appearance of counterfeit circuit breakers manufactured off-shore without regard to compliance with the requisite electric codes presents a danger both to residential as well as industrial circuit breaker consumers. Such counterfeit circuit breakers are identical in appearance to nationally manufactured authentic circuit breakers that are fabricated in strict compliance with the relevant electrical codes.

It would be greatly advantageous to insure that circuit breaker plastic enclosures are consistently manufactured from plastic materials of sufficient strength and that counterfeit circuit breakers are reliably distinguishable from authentic circuit breakers.

One purpose of the invention is to provide means for insuring that breaker enclosures are fabricated from the proper materials as well as providing indication in the field as to the origin of the circuit breaker manufacture.

SUMMARY OF THE INVENTION

The invention comprises confirmation of the addition of a dopant material in the plastic material used to fabricate circuit breaker enclosures along with reinforcement fibers. The dopant fluoresces under ultra-violet illumination to indicate that the requisite reinforcement fibers are in the plastic material before the plastic material is fabricated into circuit breaker enclosures. The circuit breakers when illuminated under ultra-violet illumination in the field readily identify the circuit breaker manufacturer.

DESCRIPTION OF THE PREFERRED EMBODIMENT

Figure 1:
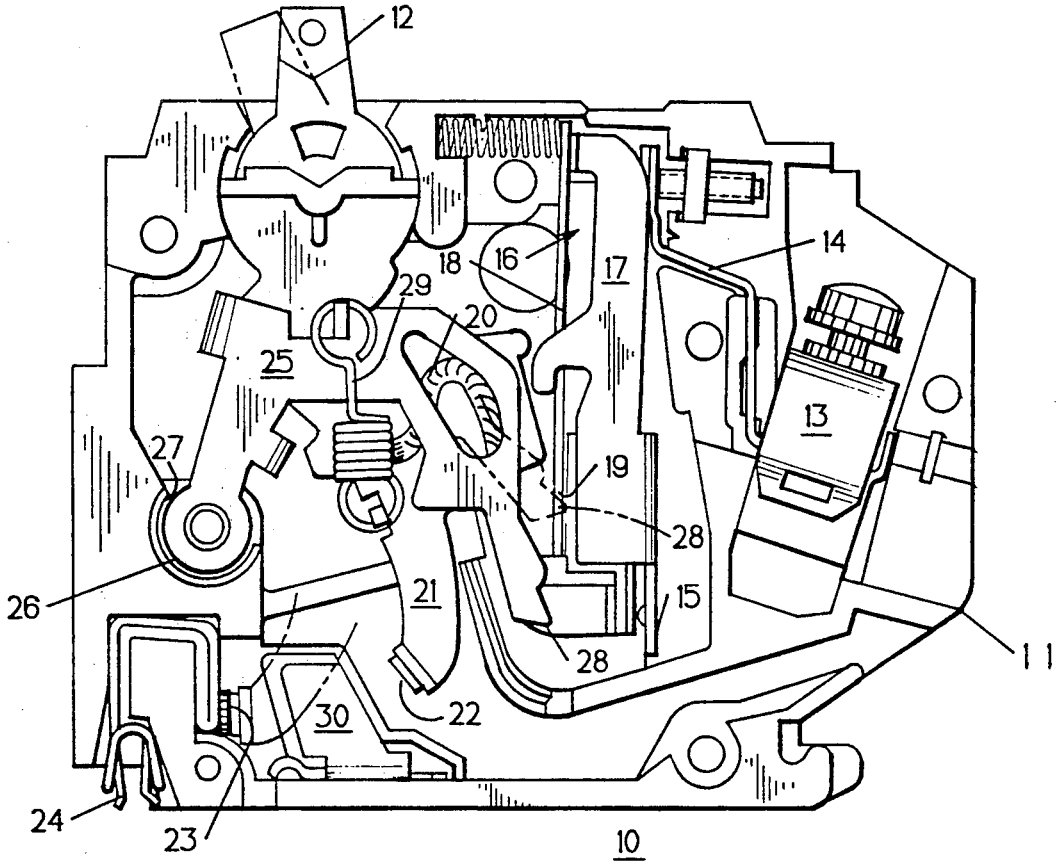
FIG. 1 is a side plan view of the circuit breaker of the invention with the cover removed to detail the circuit breaker operating components.

A molded case residential circuit breaker 10 is depicted in FIG. 1 with the cover removed to expose the components arranged within the case 11. The circuit breaker is of the type described within U.S. Pat. No. 4,513,268 and reference to this patent should be made for a more detailed description of the operation of a circuit breaker to protect a residential electrical distribution system. An operating handle 12 extends from the top of the circuit breaker to allow manual operation to reset the circuit breaker after an automatic interruption function. The current carrying path through the circuit breaker proceeds from the load terminal 13 at one end of the case, through the load strap 14, bimetal 15, within the trip unit 16, through the conductive braid 20 and movable contact arm 21 to the movable and fixed contacts 22, 23 to the line terminal 24. Under quiescent current conditions through the protected circuit, the movable contact arm 21, as indicated in phantom, is retained from rotation under the bias of the powerful operating spring 29 by engagement between the cradle tip 28 of the operating cradle 25 and the latch opening 19 formed within the armature latch 18. When the operating handle 12 is in the ON position as indicated in phantom, the movable contact 22 is held against the fixed contact 23 by the bias provided by the same operating spring 29. The radial end 26 of the cradle is rotatably supported within the bearing 27 formed within the circuit breaker case 11, as indicated. Upon the occurrence of an overcurrent condition of predetermined duration, the bimetal 15 responds to remove the cradle tip out from the armature latch and allow the movable contact arm 21 to move downwards and allow the movable contact 22 to move away from the fixed contact 23 to interrupt the circuit current. Upon so-called "instantaneous" circuit interruption caused by a short circuit within the protected circuit, the armature latch 18 is motivated by the magnetic forces generated between the magnet 17 and the armature latch 18 to rapidly separate the contacts. Upon contact separation under overload conditions, an arc is generated between the separated contacts and is cooled and quenched within the arc chamber 30 located in the vicinity of the contacts.

In accordance with the teachings of this invention, the case 11, handle 12 and cover (not shown) are fabricated from a plastic material that includes glass fibers as a filler in the range of 1.0 to 20.0% by weight of the plastic resins. To insure that the strengthening fibers are within the plastic material before fabrication into the circuit breaker case, handle and cover, a fluorescent material is added to the plastic material. One example of such a fluorescent material is UVITEX which is a registered trademark of CIBA-GEIGY CO. To ascertain the presence of the filler, the plastic material is viewed under ultra-violet light prior to using the material to form the aforementioned components. To verify that a circuit breaker in the field is of genuine manufacture and not an off-shore counterfeit copy, the circuit breaker is subjected to ultra-violet light and fluorescent response ensuring that the circuit breaker is genuine. Adequate additions of the fluorescent material vary from 0.05 to 5.00% without interfering with the electrical resistance of the plastic resin. With fluorescent materials having a fluorescent half-life of several minutes after exposure to an intense ultra-violet light source, the circuit breaker can readily be identified as the circuit breaker that has been tripped when a plurality of such circuit breakers are contained within a common enclosure such as a residential load center. The arc that is generated between the circuit breaker contacts, described earlier, includes ionized gases that emit a large quantity of ultra-violet radiation to excite the circuit breaker cover, case, and handle to fluorescence. Inspection of the load center under dark background illumination would accordingly indicate the tripped circuit breaker.

A circuit breaker having fluorescent indication means incorporated within its case, cover and handle has herein been described both as a way to insure that strength additives are included therein as well as providing authenticity of manufacture and trip indication.

Having thus described my invention, what I claim as new and desire to secure by Letters Patent is:

1. A molded case circuit breaker comprising:

a molded plastic case attached to a molded plastic cover, said case comprising plastic resins including fluorescent material additives;

a pair of separable contacts supported within said case;

an operating mechanism arranged within said case for separating said contacts and interrupting current through a protected circuit upon the occurrence of an overcurrent condition;

a molded plastic operating handle extending external to said case for manually moving said contacts between open and closed position; and an arc chamber within said case proximate said contacts for extinguishing an arc formation between said contacts when said contacts become separated during said overcurrent condition.

2. The circuit breaker of claim 1 including reinforcement fibers added to said plastic resins.

3. The circuit breaker of claim 1 wherein said cover comprises plastic resins including said fluorescent material.

4. The circuit breaker of claim 2 wherein said cover further includes said reinforcement fibers.

5. The circuit breaker of claim 4 wherein said operating handle further includes said fluorescent material.

6. The circuit breaker of claim 2 wherein said fibers comprise from 1 to 20% by weight of said plastic resins.

7. The circuit breaker of claim 1 wherein said fluorescent material comprises from 0.1 to 5.0% by weight of said plastic resins.

8. A method of identifying a circuit breaker enclosure composition comprising the steps of:

providing a composition including plastic resins and a filler material;

introducing a fluorescent material into said composition;

molding a circuit breaker enclosure from said composition; and arranging circuit breaker operating components within said enclosure to thereby fabricate a molded case circuit breaker.

9. The method of claim 8 including the step of viewing said circuit breaker enclosure under ultra-violet light to determine the presence of said fluorescent material.

10. A method of determining a circuit breaker overcurrent tripping operation comprising the steps of:

providing a composition including plastic resins and a filler material;

introducing a fluorescent material into the composition;

arranging circuit breaker operating components within said enclosure to thereby fabricate a molded case circuit breaker; and viewing said circuit breaker enclosure after an overcurrent tripping condition under low level illumination to determine whether said circuit breaker enclosure fluoresces.

* * * * *